US010415489B2

(12) United States Patent
Marconato et al.

(10) Patent No.: US 10,415,489 B2
(45) Date of Patent: Sep. 17, 2019

(54) METHOD FOR DETERMINING ACTUAL LENGTHS OF SHORT INTERVALS OF A TOOTHED TARGET OF A CRANKSHAFT

(71) Applicants: CONTINENTAL AUTOMOTIVE FRANCE, Toulouse (FR); CONTINENTAL AUTOMOTIVE GMBH, Hannover (DE)

(72) Inventors: Benjamin Marconato, Toulouse (FR); Sharath Subbana, Bangalore (IN)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 134 days.

(21) Appl. No.: 15/568,187

(22) PCT Filed: Apr. 18, 2016

(86) PCT No.: PCT/EP2016/000628
§ 371 (c)(1),
(2) Date: Oct. 20, 2017

(87) PCT Pub. No.: WO2016/169644
PCT Pub. Date: Oct. 27, 2016

(65) Prior Publication Data

US 2018/0080396 A1 Mar. 22, 2018

(30) Foreign Application Priority Data

Apr. 22, 2015 (FR) ..... 15 53592

(51) Int. Cl.
*F02D 41/00* (2006.01)
*F02D 41/24* (2006.01)
*F02D 41/12* (2006.01)

(52) U.S. Cl.
CPC ..... *F02D 41/009* (2013.01); *F02D 41/2451* (2013.01); *F02D 41/12* (2013.01)

(58) Field of Classification Search
CPC ..... F02D 41/009; F02D 41/2451; F02D 41/12
See application file for complete search history.

(56) References Cited

U.S. PATENT DOCUMENTS 5,377,535 A 1/1995 Angermaier et al.
5,377,536 A 1/1995 Angermaier et al.
(Continued)

FOREIGN PATENT DOCUMENTS

DE 41 33 679 A1 4/1993
DE 195 40 674 A1 5/1997
(Continued)

OTHER PUBLICATIONS

International Search Report, dated Jul. 21, 2016, from corresponding PCT application No. PCT/EP2016/000628.

*Primary Examiner* — Freddie Kirkland, III
(74) *Attorney, Agent, or Firm* — Young & Thompson

(57) ABSTRACT

Disclosed is a method for determining actual lengths of short intervals, shorter than one segment of a toothed target of the crankshaft. The determination method includes: —a measurement step measuring first times, each corresponding to the time that the target takes to traverse a long interval of a length of a segment, and second times, each corresponding to the time that the target takes to traverse a short interval, —a correction step calculating a first ratio between two long intervals and a second ratio between two short intervals, —a step of obtaining the actual length of each of the long intervals, —a step of calculating a difference in length between two long intervals, —and a step of determining the respective actual lengths of a pair of short intervals of the toothed target.

20 Claims, 4 Drawing Sheets

(56) References Cited

U.S. PATENT DOCUMENTS

Figure 4:
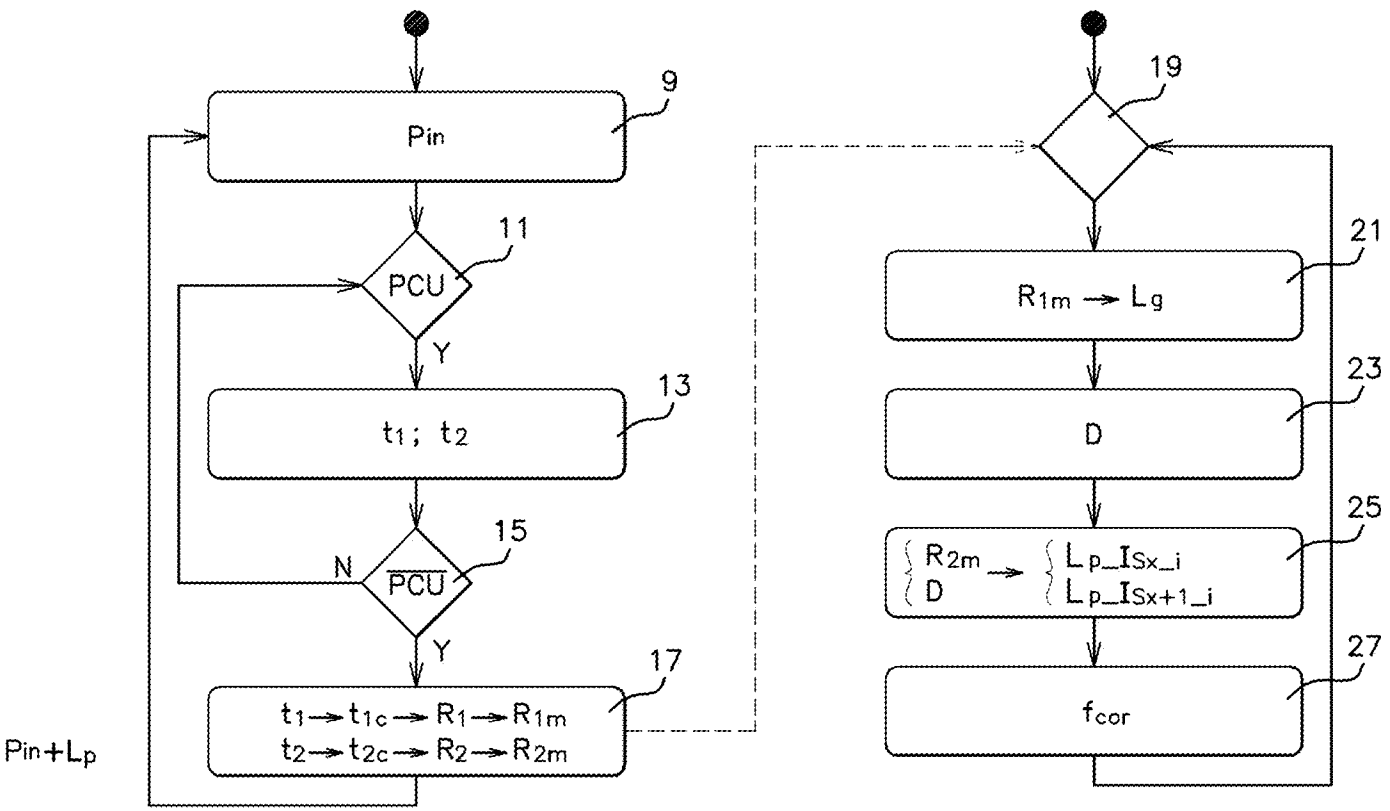

| | | | | |
|---|---|---|---|---|
| 5,428,991 | A | 7/1995 | Klenk et al. | |
| 5,789,658 | A | 8/1998 | Henn et al. | |
| 6,062,071 | A | 5/2000 | Henn et al. | |
| 6,142,011 | A | 11/2000 | Angermaier | |
| 6,931,317 | B2 * | 8/2005 | Bruns | F02D 41/0097 701/102 |
| 7,614,290 | B2 * | 11/2009 | Shikama | F02D 41/0097 73/114.25 |
| 10,041,966 | B2 * | 8/2018 | Marconato | F02D 41/009 |
| 10,234,262 | B2 * | 3/2019 | Baissac | F02P 7/067 |
| 2005/0061064 | A1 | 3/2005 | Bruns | |

FOREIGN PATENT DOCUMENTS

| | | | |
|---|---|---|---|
| DE | 196 22 042 | A1 | 12/1997 |
| DE | 10 2009 037 896 | A1 | 2/2011 |
| EP | 0 583 495 | A1 | 2/1994 |
| EP | 0 695 865 | A1 | 2/1996 |
| EP | 1 757 946 | A2 | 2/2007 |
| FR | 2 740 509 | A1 | 4/1997 |
| FR | 2 773 848 | A1 | 7/1999 |

* cited by examiner

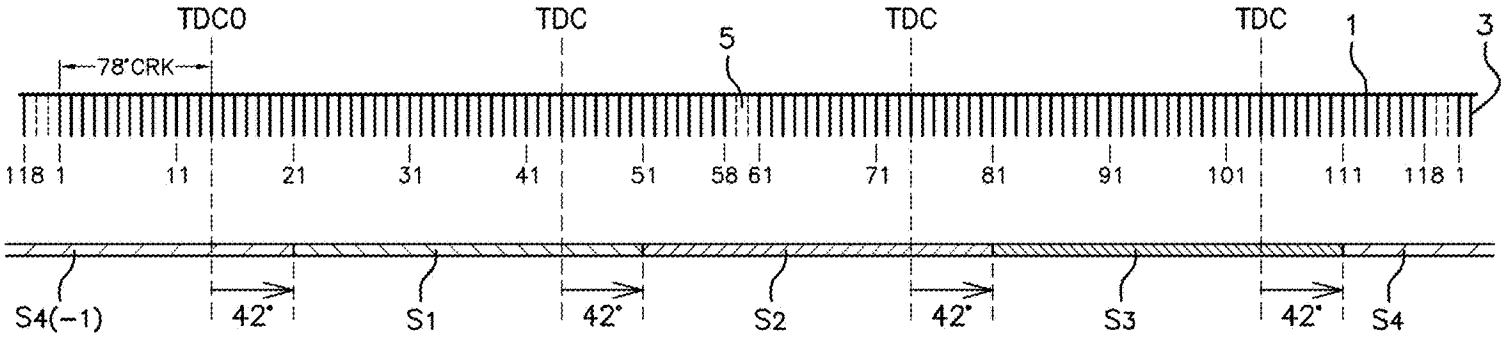
Fig 1 – PRIOR ART
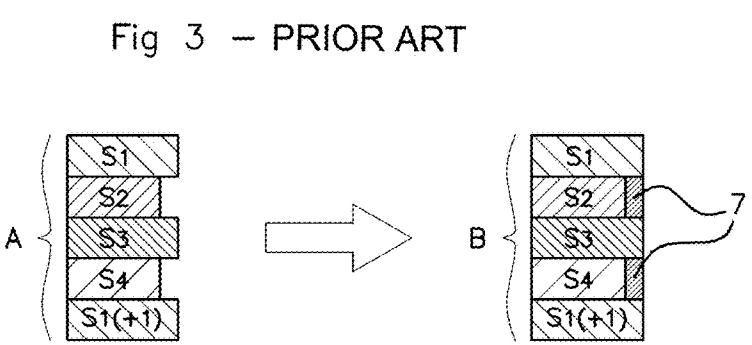
Fig 3 – PRIOR ART
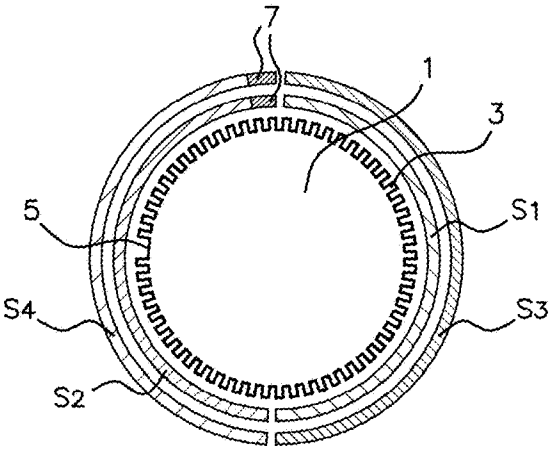
Fig 2 – PRIOR ART

METHOD FOR DETERMINING ACTUAL LENGTHS OF SHORT INTERVALS OF A TOOTHED TARGET OF A CRANKSHAFT

The present invention pertains to a method of determining actual lengths of short intervals of a toothed target of a crankshaft.

The invention finds applications in the motor vehicle industry, in particular for engine control applications.

During the operation of an internal combustion engine, many actions need to be synchronized to the geometrical position of a crankshaft. This is the case, for example, with the control of the fuel injection, the control of the ignition plugs and the managing of the distribution elements. Likewise, it is now necessary to know precisely an angular position of the crankshaft as well as its instantaneous velocity in order to optimize an operating point of the engine for processing in real time such parameters as the pressure prevailing in the different combustion chambers.

In order to meet these demands, the crankshaft is equipped with a toothed wheel joined to it, also known as a toothed target, the distribution and number of whose teeth are given, and a sensor which detects the passing of the teeth of the toothed target for the purpose of measuring the time taken by said target to traverse an interval comprising a certain number of teeth and which sends this information to an engine control system, such as a computer, which is in charge of running the engine control elements.

FIGS. 1 and 2 illustrate, respectively, in an unfolded form and in a normal form, an example of a toothed target 1 frequently found in Europe. This is present in the form of a toothed wheel of sixty teeth 3 regularly spaced every 6°. The sixty teeth are distributed over 360° and it requires two whole turns of this toothed target 1 to reproduce a complete engine combustion cycle of 720°. In order to create a reference point 5 for the sensor, the toothed target 1 in reality has fifty eight teeth 3 since the last two teeth have been removed.

In the example described here, we are interested in an engine having four cylinders, each with their own phases of combustion. These phases of combustion are consecutive and make it possible to drive the crankshaft in rotation and thus the toothed target 1 in a continuous manner Thus, each cylinder drives the movement of said target in a successive manner Each cylinder may thus be associated with a segment defining an interval of time during which the corresponding cylinder drives the toothed target 1 in rotation. A segment is thus equivalent to the distance between two engine cylinders. Each segment starts here 42° after a top dead center TDC of the corresponding cylinder and the first top dead center TDC0 of the first segment considered starts at the forteenth tooth 5 of the toothed target 1, that is, at an angular distance of 78° from the reference point 5.

In the example of FIGS. 1 and 2, a segment corresponds to an interval of thirty teeth 3 of the toothed target 1, that is, an angular length of 180°. One thus denotes, in FIG. 1, a first segment S1 between the twenty first tooth and the fifty first tooth, a second segment S2 between the fifty first tooth and the eighty first tooth, a third segment S3 between the eighty first tooth and the one hundred eleventh tooth, and a fourth segment S4 between the one hundred eleventh tooth and the twenty first tooth.

In one mode of functioning where the toothed target has an ideal shape, all the segments are equal, that is, they have the same length. One speaks here of the angular length, making reference to the angular length measured in degrees on said target. However, most of the toothed targets have mechanical defects of fabrication which are peculiar to each toothed target. In fact, during the fabrication of a toothed target, certain teeth may be poorly machined and/or the tolerances used may be sizeable. Thus, one tooth may be shorter or longer than another tooth of the same toothed target. Likewise, the toothed target may have a slightly oval shape and thus not be perfectly symmetrical. Moreover, the toothed target might not be positioned exactly centered on the crankshaft and thus present a "run-out" effect, where the target comes closer to and moves further away from the sensor, creating a measurement noise. Thus, the measurements of the sensor may have errors due to the mechanical defects of said target.

The theoretical model used to calculate the position of the crankshaft based on information detected by the sensor does not take into account the machining differences between the teeth. Thus, there might be a lack of precision as to the position of the crankshaft, as well as its velocity. In fact, an error of the order of 0.1° is enough to cause measurement uncertainties.

In the event of measurement errors due to these mechanical defects, the engine control system may still function, but with suboptimal performance in terms of pollution emissions and torque. Furthermore, the calibration of this engine control system may be hard to adjust and there may be wrong interpretations of the measurements.

One method enabling a learning of and compensation for these mechanical defects on the scale of one segment length is presently known. In fact, the document EP 0583495 proposes a method able to identify and correct the potential mechanical defects on the scale of one segment length by calculating a ratio of lengths between two segments. That is, the method proposed compares actual lengths of the segments based on time measurements performed for these segments. However, this method is not able to determine the actual lengths of these segments.

FIGS. 2 and 3 illustrate the result of an adaptation of the size of the segments as done by a method of learning and compensation. A portion A represents a group of segments whose respective lengths have been measured and a portion B represents the same group of segments whose respective lengths have been corrected by adding a correction 7 to each shorter segment in order to make all the lengths equal and thereby compensate for the mechanical defects.

At present, certain new engine control strategies require information as to the position and the speed of the crankshaft on a scale smaller than one segment in order to estimate more precisely a torque produced by the engine at each moment of its operating cycle. In particular, the new strategies for analysis of the combustion require more precise information as to the position and the speed of the crankshaft especially around each top dead center.

However, it is not possible to simply adapt the size of the measurement interval to define an interval shorter than one segment and still use the method of learning and compensation presented above. This method applies when the motor vehicle is in a deceleration mode, since this deceleration may be considered to be linear on the scale of the segments. Nevertheless, even in this deceleration mode, the engine always includes points of compression. Thus, on a scale smaller than a segment, this deceleration cannot be considered as being linear. For example, half the length of a segment does not correspond to half the time taken by the toothed target to traverse an entire segment.

The present invention intends in particular to propose a method of learning and compensation of the mechanical defects of a toothed target on a scale smaller than one segment.

In particular, the present invention intends to propose a method of determining actual lengths of intervals shorter than segments.

The method according to the invention will also be preferably automatic and/or easily regulated and/or have a good reliability and/or a modest cost price.

Moreover, the present invention intends to propose a method which does not disturb the normal functioning of an engine and has no need for maintenance.

Thus, the purpose of the present invention is to improve the measurement precision of the position and the speed of the crankshaft while facilitating the calibration and the implementing of the various engine control systems about a motor vehicle.

For this purpose, the present invention proposes a method of determining actual lengths of short intervals of a toothed target of a crankshaft of a motor vehicle. According to the present invention, a short interval corresponds to a portion smaller than a segment of said toothed target and is formed by a predetermined number of teeth of the toothed target. Likewise, according to the present invention, a segment is divided into a whole number of short intervals and the predetermined number of teeth is an identical whole number for each short interval. Moreover, according to the present invention, the method of determination is implemented when said motor vehicle is in a deceleration mode and it involves:

a measurement step involving the following phases performed in parallel:

successive measurement of first times, each one corresponding to the time it takes said target to traverse a long interval of a length of a segment, starting from an initial point corresponding to the start of each long interval, until obtaining at least one measurement for each long interval, and successive measurement of second times, each one corresponding to the time it takes said target to traverse a short interval, starting from said initial point associated with the corresponding long interval, until obtaining at least one measurement for one short interval per each long interval measured, the measurements of the first times and the measurements of the second times being repeated in a staggered manner, during each deceleration mode, each initial point having a length equal to a short interval, a correction step involving the following phases performed in parallel:

calculation of a first relative ratio between two long intervals by dividing a first time of a first long interval, starting at an initial point, by another first time of a second long interval starting at the same initial point, staggered by a long interval, the first time of a same long interval being measured several times and the correction step furthermore involving a convergence phase consisting in making the first ratios corresponding to a same long interval converge on a first mean ratio, and calculation of a second relative ratio between two short intervals by dividing a second time of a first short interval, starting at the same initial point, by another second time of a second short interval starting at the same initial point, staggered by a long interval, a step of obtaining the actual length of each of the long intervals, from the mean relative ratios, as follows:

$$L_g(x) = 720° \times R_{1m}(x) \Big/ \sum_i R_{1m}(i)$$

with:

$L_g(x)$=actual length of the long interval x being considered $R_{1m}(x)$=first relative mean ratio $R_{1m}$ of the long interval x being considered, $R_{1m}(i)$=first relative mean ratio $R_{1m}$ of each of the long intervals corresponding to the engine cylinders, for example i ranging from 1 to 4 for a four-cylinder engine, a step of calculating a difference of lengths between two long intervals by subtracting an actual length of a first long interval starting at the initial point with another actual length from a second long interval starting at the same initial point, staggered by a short interval, and a step of determination of the respective actual lengths of a pair of short intervals of the toothed target associated during the calculation of the second ratio and the difference of lengths, the correction step, the step of obtaining the actual length of each of the long intervals, the step of calculation and the step of determination being repeated to determine each pair of short intervals of the toothed target.

Tests have shown that such a method of determination is particularly well suited to determining in a precise and reliable manner the position of the toothed target and thus enabling a deducing of the position and the speed of the crankshaft during an engine operation cycle.

The fact of being able to determine the position of the toothed target on a scale smaller than one segment makes it possible to optimize the entire engine operation, in particular by utilizing this information for example to refine the injection settings or to balance out the operation of the cylinders with respect to each other. Moreover, this also helps to reveal the distribution of mechanical defects along the segment in question and in particular to determine more precisely the different parameters influencing the combustion around the top dead center, or TDC point, of each cylinder.

Moreover, the fact of staggering the measurements of the first times by a length equal to a short interval makes it possible to obtain the difference of lengths. Likewise, the fact of comparing the measurements of two second times whose corresponding short intervals are separated by a length equal to a segment makes it possible to obtain the second ratio. Moreover, the fact of combining the calculation of the difference of lengths with the calculation of the second ratio makes it possible to easily determine the respective actual lengths of a pair of short intervals and thereby deduce the positioning of the mechanical defects on a scale of a short interval.

Likewise, the fact that each short interval comprises a finite number of teeth makes it possible to facilitate the measurement of each second time by using the teeth as reference points for the measurements.

Moreover, the fact that a segment is divided into a whole number of short intervals makes it possible to obtain measurements per cylinder so as to compare the performance of the cylinders among each other and balance them out if needed.

What is more, the fact that the method is applied during a deceleration mode of the motor vehicle makes it possible to simplify the calculations statistically by considering that the deceleration of the engine is linear.

The step of obtaining the actual length of each of the long intervals makes it possible to obtain the actual lengths of the long intervals in an absolute manner, that is, there is no long interval used as a reference interval with a zero error as compared to a theoretical length. Thus, this makes it possible to distribute the measured error while centering it on each long interval, that is, the sum of the errors is zero for a length equal to one combustion cycle.

In one advantageous embodiment, the correction step furthermore involves a phase of correction of each first time by a deceleration factor. Furthermore, in one advantageous embodiment the correction step involves another phase of correction of each second time by a deceleration factor.

In fact, during the same deceleration, the first times and the second times measured for a same interval increase when the velocity of the vehicle decreases. Thus, the different measurements of a same interval may yield very different results. The fact of correcting the measurement values of the first times and the second times by a deceleration factor is possible because the deceleration is considered to be linear. This phase of correction thus facilitates the comparison between the different first times and the different second times, respectively, by making equal the different measurements of the same intervals.

For purposes of optimization, the second time of a same short interval is advantageously measured several times and the correction step involves, furthermore advantageously, another phase of convergence, consisting in making the second ratios converge on a second mean ratio.

The repeating of the different measurements and the two phases of convergence allow increased reliability of the measurements by obtaining a mean ratio corresponding to each measurement instance. Moreover, the fact of calculating the actual lengths of the short intervals by using these mean ratios makes it possible to disregard any measurement error, or the quality of the road on which the motor vehicle is moving. In fact, imperfections in the road such as holes or bumps may cause errors in the learning process.

In an original manner, the step of determination may consist, for the last short interval of a segment being determined, in subtracting from an actual length of said corresponding segment, a sum of the actual lengths of each other short interval of that segment. Taking into account calculations already performed in order to calculate the last actual lengths of each segment makes it possible to simplify the calculations and increase their rapidity.

Moreover, the method of determination advantageously includes a step of deducing a respective correction factor for each short interval of the toothed target as a function of the actual length calculated and a theoretical length of the corresponding short interval. The fact of calculating a correction factor for each short interval makes it possible to take account of the measurement error prior to using the measured times in order to calculate the different parameters used for the engine control.

Finally, the present invention concerns an electronic module for determination of actual lengths of short intervals of a toothed target of a crankshaft of a motor vehicle. The electronic module for determination comprises means of implementing each of the steps of the method of determination as previously described.

Figure 5:
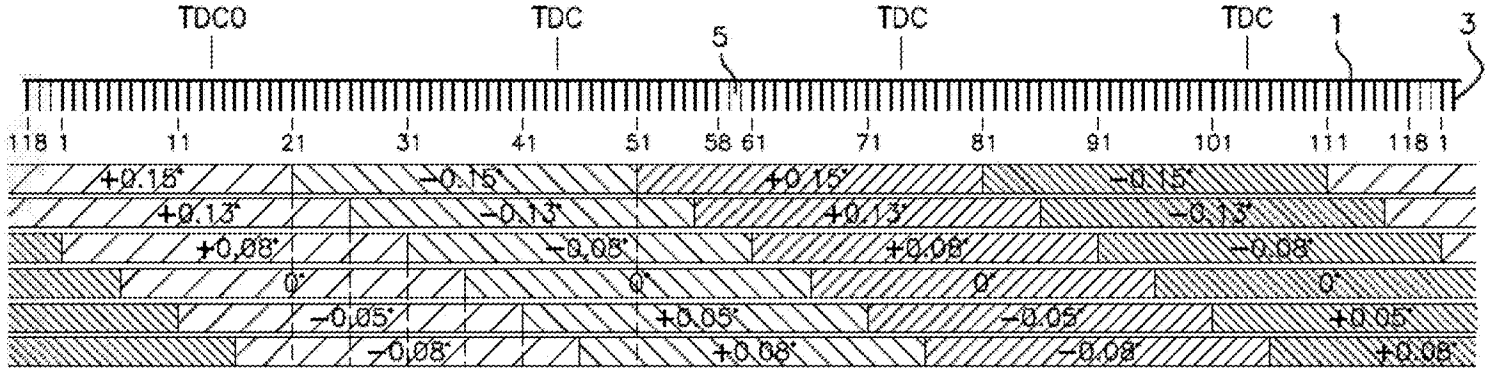
Figure 6:
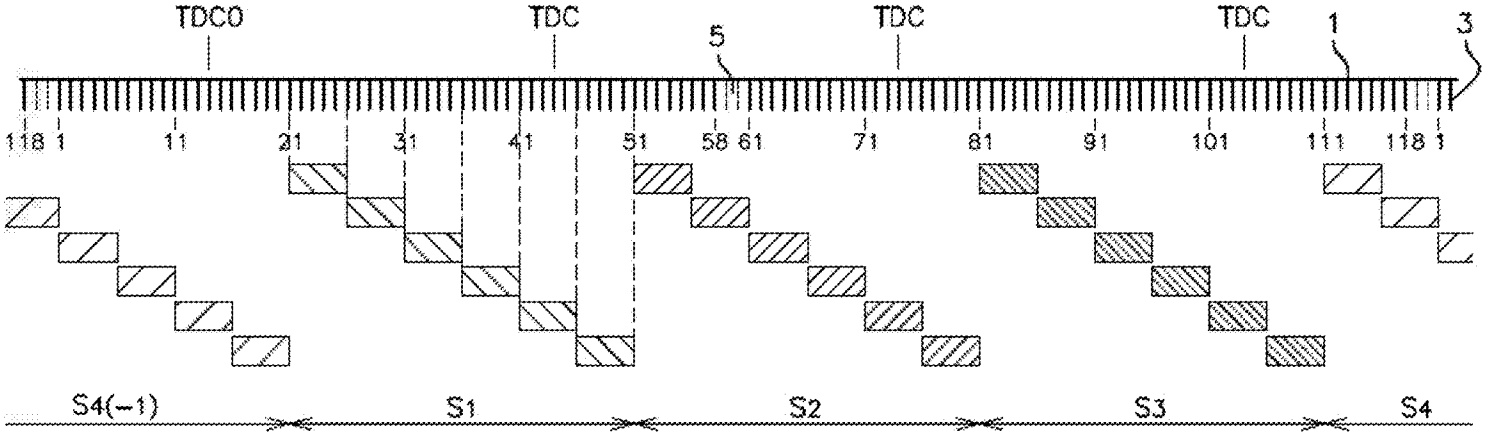
Figure 7:
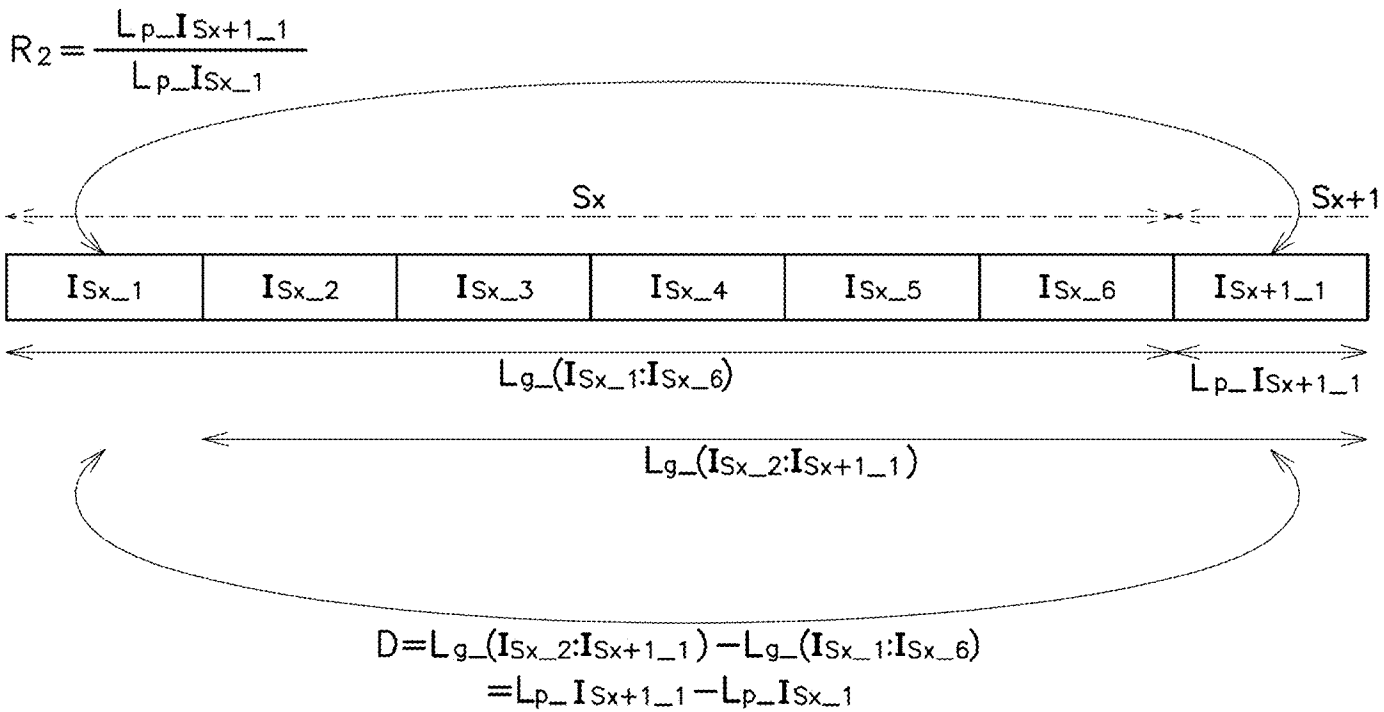

Details and advantages of the present invention will appear better from a perusal of the following description, making reference to the appended schematic diagrams, in which:

FIG. 1 is a schematic unfolded view of an example of a toothed target of the prior art, FIG. 2 is a schematic example of said target of FIG. 1, FIG. 3 is a schematic diagram illustrating a method of learning and compensation of the prior art, FIG. 4 is a flow chart of a method for determination of actual lengths of short intervals of a toothed target according to one embodiment, FIG. 5 is a schematic unfolded view of a toothed target illustrating the long intervals according to one embodiment, FIG. 6 is a schematic unfolded view of a toothed target illustrating the short intervals according to the embodiment of FIG. 5, and FIG. 7 is a diagram illustrating a calculation step according to the embodiment of FIG. 5.

FIG. 4 illustrates a method of determination of actual lengths of short intervals of a toothed target of a crankshaft of a motor vehicle. In this example, the method of determination is explained with regard to a four-cylinder engine. The toothed target considered in this example is thus the toothed target 1 of the prior art, described previously with regard to FIGS. 1 and 2 comprising the segments S1, S2, S3 and S4.

A short interval corresponds to a portion of the toothed target 1 smaller than a segment, such that a segment is divided into several short intervals. Each short interval is formed by a predetermined number of teeth 3 of said target. The predetermined number of teeth is a whole number, that is, each short interval comprises a whole number of teeth. Moreover, each short interval comprises the same number of teeth. In this sample embodiment, a short interval comprises five teeth 5 and thus theoretically measures a length equal to 30°. Each segment S1, S2, S3 and S4 is thus divided into six short intervals.

The method of determination involves an initial step 9 of determination of an initial point $p_{in}$. The initial point $p_{in}$ corresponds to a starting point of a long interval. A long interval corresponds to a portion of the toothed target 1 comprising the same number of teeth as a segment. In this sample embodiment, a first initial point $p_{in}$ is equal to 42° considering that a first top dead center TDC0 is equal to 0°.

The method of determination then waits, during a first polling step 11, for the motor vehicle to be in a deceleration mode. The deceleration mode preferably corresponds to a so-called raised foot mode, when no command is sent to the engine (neither acceleration nor braking). In fact, in this raised foot mode the deceleration of the engine may be considered as being linear. Moreover, to enable dependable measurements, the raised foot mode should be in acceptable velocity ranges, that is, not too low, and long enough to present good conditions of stability for the measurements.

When the motor vehicle is in a deceleration mode, the method of determination then involves a measurement step 13. This measurement step 13 involves a first phase of measurement and a second phase of measurement, which are done in parallel.

The first phase of measurement is illustrated by FIG. 5. During this first phase of measurement, a sensor associated with the toothed target 1 measures a first time $t_1$ corresponding to the time it takes for said target to traverse a long interval. The first time $t_1$ thus corresponds to the time elapsed between the passing before the sensor of the first tooth of the long interval considered as being the initial point $p_{in}$, and the passing before the sensor of the last tooth of the same long interval. The sensor thus measures successively the respective first times $t_1$ of each long interval considered in a combustion cycle. Thus, in this example of a four-cylinder engine, there are four measurements of first times $t_1$.

The second phase of measurement is illustrated by FIG. 6. During this second phase of measurement, the same sensor measures a second time $t_2$ corresponding to the time it takes for the toothed target 1 to traverse a short interval, that is, the time elapsed between the passing before the sensor of the first tooth of the short interval and the passing before the sensor of the last tooth of the same short interval. The first tooth of the short interval here is the same first tooth as that of the corresponding long interval. The sensor thus measures the respective second times of each short interval considered, and so as before there are four measurements of second times $t_2$.

Once the eight measurements are obtained, if the motor vehicle is still in the deceleration mode, the measurement step 13 is then repeated. One thus obtains several measurements of each first time $t_1$ and each second time $t_2$.

When the motor vehicle is no longer in the deceleration mode, during a second polling step 15, the method of determination then involves a correction step 17 for the first times $t_1$ and/or the second times $t_2$ measured during the measurement step 13.

The correction step 17 may involve a first phase of correction of each first time $t_1$ measured by a deceleration factor. This phase of correction may consist in comparing a first time $t_1$ measured for an interval with another first time $t_1$ measured for the same interval located one engine combustion cycle later on. These first two measured times $t_1$ thus correspond to a same length of interval since it involves the same portion of the toothed target. Thus, because of the mechanical deceleration of the vehicle, the other first time $t_1$ is longer than said first time $t_1$. This mechanical deceleration may thus be calculated in order to determine the correction factor to be applied to all the measurements of the first times $t_1$ for this engine cycle. The deceleration factor is adapted as a function of the speed of the motor vehicle and the deceleration distance. One thus obtains a first corrected time $t_{1c}$ for each corresponding first time $t_1$.

The correction step 17 may likewise include a second phase of correction of each measured second time $t_2$ by said deceleration factor. Similarly, one thus obtains a corrected second time $t_{2c}$ for each corresponding second time $t_2$.

Next, the correction step 17 calculates, in a first phase of calculation, a first ratio $R_1$ between two long intervals by dividing a corrected first time $t_{1c}$ of a first long interval by another corrected first time $t_{1c}$ of a second long interval, the first long interval and the second long interval having their respective initial point $p_{in}$ spaced apart on the toothed target 1 by a length equal to the length of a long interval.

Likewise, a second ratio $R_2$ of a short interval is determined, in a second phase of calculation, between two short intervals by dividing a corrected second time $t_{2c}$ of a first short interval by another corrected second time $t_{2c}$ of a second short interval, the first short interval and the second short interval having their respective initial point $p_{in}$ spaced apart on the toothed target 1 by a length equal to the length of a long interval.

These calculations are done for each corrected ratio $t_{1c}$ and $t_{2c}$ considering that each corrected ratio of durations is equal to the ratio of lengths corresponding respectively to a same long interval or a same short interval.

The correction step 17 furthermore involves a first phase of convergence consisting in associating each first ratio $R_1$ corresponding to the same long interval in order to determine a mean ratio $R_{1m}$. The correction step 17 may furthermore involve a second phase of convergence consisting in associating each second ratio $R_2$ corresponding to the same short interval in order to determine a mean ratio $R_{2m}$.

Once a first mean ratio $R_{1m}$ and a second mean ratio $R_{2m}$ have been obtained respectively for the four long intervals considered and for the four short intervals considered, the method of determination returns to the initial step 9 where a second initial point $p_{in}$ is determined. For this, the initial point $p_{in}$, on said toothed target 1, is staggered by a length equal to a short interval. In this example, the second initial point $p_{in}$ is thus equal to 72°. When the motor vehicle represents a deceleration mode, the measurement step 13 and the correction step 17 are repeated. Then the initial point $p_{in}$ is again staggered by the same length and so on until the initial point $p_{in}$ returns to its initial value. Thus, in this example, the initial point $p_{in}$ is successively equal to 42°, 72°, 102°, 132°, 162°, 192° and then returns to 42°. One thus obtains a first mean ratio $R_{1m}$ and a second mean ratio $R_{2m}$, respectively, for each long interval and for each short interval of the toothed target 1.

The method of determination then involves a step of obtaining 21 the actual length $L_g$ of each of the long intervals, after a third polling step 19 to verify that each first time and each second time have been measured for each initial point $p_{in}$.

The step of obtaining 21 the actual length $L_g$ of each of the long intervals consists in defining the actual lengths of the segments from the first mean ratios $R_{1m}$ of a same combustion cycle. The relative ratios make it possible to find the relative lengths of the corresponding segments with respect to each other. One adopts the hypothesis that the sum of the first four actual lengths is equal to 720°. As explained further below, one thus determines, in an absolute fashion, a first actual length $L_g$ for each long interval. The sum of the absolute errors is then zero. This step of obtaining 21 the actual length $L_g$ of each of the long intervals is illustrated in FIG. 5 by the angles representing the error attributed to each long interval as compared to the other long interval associated with the same revolution of the toothed target, and is described in further detail below.

Taking into account the above, one obtains a system of five equations (four with the first mean ratios, and one with the sum of the four actual lengths of the long intervals) in four unknowns (lengths of the long intervals), as detailed below:

$$R_{1m}(i)=L_g(i)/L_g(1)$$

for i ranging from 1 to 4 for a four-cylinder engine in the example, and $$\sum_{i=1}^{i=4} L_g(i) = 720°$$

The first four equations are obtained as follows:

We have defined above: $R_1(i)=t_{1c}(i)/t_{1c}(1)=L_g(i)/L_g(1)$ which is equivalent to the ratio of the actual lengths, as explained above, and with the first phase of convergence one moves from $R_1(i)$ to $R_{1m}(i)$.

The resolution of this system of equations makes it possible to find the four actual lengths $L_g$.

A relative ratio between two long intervals as defined above is expressed as follows, based on the measured lengths:

$$R_{1m}(x)=L_g(x)/L_g(1)$$

Calculating the sum of the mean relative ratios one obtains the actual length $L_g(1)$ of the long interval 1.

We then express the length of a long interval in an absolute manner, as a function of the mean relative ratios and without using other measured lengths, as follows:

$$L_g(x) = 720° \times R_{1m}(x) \Big/ \sum_{i=1}^{i=4} R_{1m}(i)$$

for the example of a four-cylinder engine, i ranging from 1 to 4.

The method of determination further involves a calculation step 23, illustrated in FIG. 7 for a pair of short intervals. The calculation step 23 consists in calculating a difference of lengths D between two long intervals by subtracting a first actual length $L_g$ of a first long interval with another first actual length $L_g$ of a second long interval, the first long interval and the second long interval having their respective initial point $p_{in}$ spaced apart on the toothed target 1 by a length equal to the length of a short interval.

In the example of FIG. 7, the difference in lengths D is equal to the difference between a first actual length $L_{g_(}$Is1_1: Is1_6$_)$ of a first long interval [Is1_1: Is1_6] and a first actual length $L_{g_(}$Is1_2: Is2_1$_)$ of a second long interval [Is1_2: Is2_1]. These first two actual lengths being known, we then obtain a value of the difference in lengths D. Moreover, by decomposing the calculations, that is, by developing the first two actual lengths as being the sum of the second actual lengths of the corresponding short intervals, we deduce that the difference in lengths D is likewise equal to the difference between a second actual length $L_{p_}$Is1_1 of a first short interval Is1_1 and a second actual length $L_{p_}$Is2_1 of a second short interval Is2_1.

The method of determination then involves a step of determination 25 of the respective second actual lengths $L_p$ of the pair of short intervals spaced apart, on the toothed target 1, by a length equal to a long interval. In the example of FIG. 7, the pair of short intervals is composed of the first short interval $Is_{1_1}$ and the second short interval $Is_{2_1}$.

The step of determination 25 then consists in solving a system of two equations in two unknowns, the equations being the calculation of the difference in lengths D calculated during the calculation step 23 and that of the second mean ratio $R_{2m}$ as calculated during the correction step 17, associated with the same pair of short intervals, and the two unknowns being the two second actual lengths of said pair of short intervals, as below:

$$\begin{cases} D = L_{p_Is2_1} - L_{p_Is1_1} \\ R_{2m} = \dfrac{L_{p_Is2_1}}{L_{p_Is1_1}} \end{cases} \rightarrow \begin{cases} L_{p_Is1_1} = \dfrac{D}{R_{2m} - 1} \\ L_{p_Is2_1} = \dfrac{R_{2m} * D}{R_{2m} - 1} \end{cases}$$

In the example of FIG. 7, the second mean ratio $R_{2m}$ is equal to the ratio between a second actual length $L_{p_}$Is1_1 of a first short interval Is1_1 and a second actual length $L_{p_}$Is2_1 of a second short interval Is2_1.

The calculation step 23 and the determination step 25 are repeated successively to determine each pair of short intervals of the toothed target 1. Furthermore, in order to determine the second actual length $L_p$ of the last short interval of a segment, the determination step 25 may simply consist in subtracting from a first actual length $L_g$ of the long interval corresponding to that segment a sum of the second actual lengths $L_p$, previously determined, of each other short interval of the corresponding segment. This variant of the determination step 25 may furthermore be applied in the case when the difference in lengths D is zero for a pair of short intervals and the second mean ratio $R_{2m}$ is equal to 1, corresponding to the case where the two short intervals have the same error. In this specific case, the preceding system of equations cannot be solved. One then makes use of the sum of the other second actual lengths $L_p$ and of the first actual length $L_g$ of the corresponding segment to determine the respective second actual lengths of said pair of short intervals.

The method of determination may furthermore involve a step of deducing 27 a correction factor $f_{Cor}$. For this, each actual length $L_p$ calculated is compared to a theoretical length of the same short interval in order to deduce the corresponding correction factor $f_{Cor}$.

The method of determination is formed by a first portion, bringing together the initial step 9, the measurement step 13, the correction step 17 and the two polling steps 11 and 15, and a second portion, bringing together the step of obtaining 21 the actual length of each of the long intervals, the calculation step 23, the determination step 25 and the deduction step 27. These first and second portions may be performed in parallel with each other, considering that the information resulting from the correction step 17 is transmitted to the step of obtaining 21 the actual length of each of the long intervals. The polling step 19 then makes it possible to separate these two portions and to make sure that the step of obtaining 21 the actual length of each of the long intervals in fact has the transmitted information before commencing, that is, that the first portion has been carried out at least one time before the second portion commences.

The invention more particularly concerns an electronic module for determination of second actual lengths $L_p$ of short intervals of a toothed target 1 of a crankshaft of a motor vehicle. The electronic module for the determination comprises means of implementing each of the steps of the determination method described previously.

In one variant embodiment, the length of a short interval has values different from 30°, for example equal to 60° or 90°. It is likewise possible to use short intervals of length equal to 6°. However, in this latter case, the measurement error of the sensor might be too large as compared to the measured information.

In one variant embodiment, the first phase of correction and the second phase of correction may be realized by using any other method known in the prior art to determine the deceleration factor.

Furthermore, in one variant embodiment the measurement step could involve a single phase of measurement consisting in measuring all the second times of the short intervals. The first times of the long intervals could then be determined by addition of the second times of the successive short intervals making up a long interval.

The present invention makes it possible to determine in a dependable and rapid manner the actual lengths of each short interval of the toothed target of the crankshaft.

The present invention also makes it possible to determine effectively the actual lengths of portions of the toothed target which are smaller than segments and thus to find the distribution of the errors along a segment.

Moreover, the present invention can facilitate the calibration of the engine and also avoid a misinterpretation of a shorter or longer tooth and thus avoid a compensation where none is required, since the imbalance is due to the measurements and not to the actual speed of the engine.

Furthermore, by enabling a learning process for mechanical defects and in particular machining defects in an automatic manner and during a normal operating cycle of the engine, the present invention makes it possible to adapt the compensation of these defects without any calibration of the engine being needed.

The present invention also makes it possible to calculate correction factors to adapt the use of the lengths of the short intervals during subsequent calculations in order to take account of the mechanical defects of said toothed target. Thus, the present invention is able to enhance the performance of the engine by improving the precision of these subsequent calculations.

The invention can be applied to different types of combustion engine regardless of the number of cylinders of the latter; for example, a combustion engine having five cylinders. In this case, a segment has a length of 144° and a short interval may for example have a length of 24°.

Furthermore, in one variant embodiment, the invention may apply to different toothed targets, regardless of the number of teeth of said target and/or regardless of the spacing between each tooth. For example, a toothed target may comprise 36 teeth, or 24 teeth, or even 120 teeth.

The present invention may find application for example in devices which implement a method of measurement of the speed of a crankshaft of an engine through a combustion cycle and/or its position throughout the cycle. In fact, in order to determine these characteristics in a sufficiently precise manner, it is necessary to know the actual lengths of each short interval in order to weight each measurement of the time it takes for the toothed target to traverse a short interval with the actual length of the corresponding short interval in order to take account of the mechanical uncertainties of the toothed target.

The measurements of the speed and/or the position of the crankshaft may be used, for example, in methods enabling a determination, during the course of a combustion cycle, of the quantity of heat released, a balancing of the cylinders with respect to one another, a determining of the pressure prevailing in the cylinders, an estimation of the torque produced, and an estimating of the regularity of the combustions.

Of course, the present invention is not limited to the preferred embodiment and the variant embodiments presented above as nonlimiting examples. It also involves the variant embodiments within the scope of the skilled person in the context of the following claims.

The invention claimed is:

1. A method of determining actual lengths ($L_p$) of short intervals ($I_{Sx_i}$) of a toothed target (1) of a crankshaft of a motor vehicle, a short interval ($I_{Sx_i}$) corresponding to a portion smaller than a segment (Sx) of said toothed target (1) and being formed by a predetermined number of teeth (3) of the toothed target (1), a segment (Sx) being divided into a whole number of short intervals ($I_{Sx_i}$) and the predetermined number of teeth (3) being an identical whole number for each short interval ($I_{Sx_i}$), said method of determination being implemented when said motor vehicle is in a deceleration mode, the method comprising:

a measurement step (13) involving the following phases performed in parallel:

successive measurement of first times ($t_1$), each one corresponding to the time it takes said target (1) to traverse a long interval of a length of a segment (Sx), starting from an initial point ($p_{in}$) corresponding to the start of each long interval, until obtaining at least one measurement for each long interval, and successive measurement of second times ($t_2$), each one corresponding to the time it takes said target (1) to traverse a short interval ($I_{Sx_i}$), starting from said initial point ($p_{in}$) associated with the corresponding long interval, until obtaining at least one measurement for one short interval ($I_{Sx_i}$) per each long interval measured, the measurements of the first times ($t_1$) and the measurements of the second times ($t_2$) being repeated in a staggered manner, during each deceleration mode, each initial point ($p_{in}$) having a length equal to a short interval ($I_{Sx_i}$), a correction step (17) involving the following phases performed in parallel:

calculation of a first relative ratio ($R_1$) between two long intervals by dividing a first time ($t_1$) of a first long interval, starting at an initial point ($p_{in}$), by another first time ($t_1$) of a second long interval starting at the same initial point ($p_{in}$), staggered by a long interval, the first time ($t_1$) of a same long interval being measured several times and the correction step (17) furthermore involving a convergence phase consisting in making the first ratios ($R_1$) corresponding to a same long interval converge on a first mean ratio ($R_{1m}$), and calculation of a second relative ratio ($R_2$) between two short intervals ($I_{Sx_i}$) by dividing a second time ($t_2$) of a first short interval ($I_{Sx_i}$), starting at the same initial point ($p_{in}$), by another second time ($t_2$) of a second short interval ($I_{Sx+1_i}$) starting at the same initial point, staggered by a long interval, a step of obtaining (21) the actual length ($L_g$) of each of the long intervals, from the mean relative ratios, as follows:

$$L_g(x) = 720° \times R_{1m}(x) \Big/ \sum_i R_{1m}(i)$$

a step of calculating (23) a difference of lengths (D) between two long intervals by subtracting an actual length ($L_g$) of a first long interval starting at the initial point ($p_{in}$) with another actual length ($L_g$) from a second long interval starting at the same initial point ($p_{in}$), staggered by a short interval ($I_{Sx_i}$), and a step of determination (25) of the respective actual lengths ($L_p$) of a pair of short intervals ($I_{Sx_i}$, $I_{Sx+1_i}$) of the toothed target (1) associated during the calculation of the second ratio ($R_2$) and the difference of lengths (D), the correction step (17), the step of obtaining (21) the actual length of each of the long intervals, the step of calculation (23) and the step of determination (25) being repeated to determine each pair of short intervals ($I_{Sx_i}$, $I_{Sx+1_i}$) of the toothed target.

2. The method of determination as claimed in claim 1, wherein the correction step (17) furthermore involves a phase of correction of each first time ($t_1$) by a deceleration factor.

3. The method of determination as claimed in claim 2, wherein the correction step (17) moreover involves another phase of correction of each second time ($t_2$) by a deceleration factor.

4. The method of determination as claimed in claim 2, wherein the second time ($t_2$) of a same short interval ($I_{Sx_i}$) is measured several times and the correction step (17) involves, furthermore, another phase of convergence, consisting in making the second ratios ($R_2$) converge on a second mean ratio ($R_{2m}$).

5. The method of determination as claimed in claim 2, wherein the step of determination (25) consists, for the last short interval ($I_{Sx_i}$) of a segment being determined, in subtracting from an actual length ($L_g$) of said corresponding segment (Sx), a sum of the actual lengths ($L_p$) of each other short interval of that segment (Sx).

6. The method of determination as claimed in claim 2, further comprising a step of deducing (27) a respective correction factor ($f_{cor}$) for each short interval ($I_{Sx_i}$) of the toothed target (1) as a function of the actual length ($L_p$) calculated and a theoretical length of the corresponding short interval ($I_{Sx_i}$).

7. An electronic module for determination of actual lengths ($L_p$) of short intervals ($I_{Sx_i}$) of a toothed target (1) of a crankshaft of a motor vehicle comprising means of implementing each of the steps of a method of determination as claimed in claim 2.

8. The method of determination as claimed in claim 1, wherein the correction step (17) moreover involves another phase of correction of each second time ($t_2$) by a deceleration factor.

9. The method of determination as claimed in claim 8, wherein the second time ($t_2$) of a same short interval ($I_{Sx_i}$) is measured several times and the correction step (17) involves, furthermore, another phase of convergence, consisting in making the second ratios ($R_2$) converge on a second mean ratio ($R_{2m}$).

10. The method of determination as claimed in claim 8, wherein the step of determination (25) consists, for the last short interval ($I_{Sx_i}$) of a segment being determined, in subtracting from an actual length ($L_g$) of said corresponding segment (Sx), a sum of the actual lengths ($L_p$) of each other short interval of that segment (Sx).

11. The method of determination as claimed in claim 8, further comprising a step of deducing (27) a respective correction factor ($f_{cor}$) for each short interval ($I_{Sx_i}$) of the toothed target (1) as a function of the actual length ($L_p$) calculated and a theoretical length of the corresponding short interval ($I_{Sx_i}$).

12. The method of determination as claimed in claim 1, wherein the second time ($t_2$) of a same short interval ($I_{Sx_i}$) is measured several times and the correction step (17) involves, furthermore, another phase of convergence, consisting in making the second ratios ($R_2$) converge on a second mean ratio ($R_{2m}$).

13. An electronic module for determination of actual lengths ($L_p$) of short intervals ($I_{Sx_i}$) of a toothed target (1) of a crankshaft of a motor vehicle comprising means of implementing each of the steps of a method of determination as claimed in claim 8.

14. The method of determination as claimed in claim 12, wherein the step of determination (25) consists, for the last short interval ($I_{Sx_i}$) of a segment being determined, in subtracting from an actual length ($L_g$) of said corresponding segment (Sx), a sum of the actual lengths ($L_p$) of each other short interval of that segment (Sx).

15. The method of determination as claimed in claim 12, further comprising a step of deducing (27) a respective correction factor ($f_{cor}$) for each short interval ($I_{Sx_i}$) of the toothed target (1) as a function of the actual length ($L_p$) calculated and a theoretical length of the corresponding short interval ($I_{Sx_i}$).

16. An electronic module for determination of actual lengths ($L_p$) of short intervals ($I_{Sx_i}$) of a toothed target (1) of a crankshaft of a motor vehicle comprising means of implementing each of the steps of a method of determination as claimed in claim 12.

17. The method of determination as claimed in claim 1, wherein the step of determination (25) consists, for the last short interval ($I_{Sx_i}$) of a segment being determined, in subtracting from an actual length ($L_g$) of said corresponding segment (Sx), a sum of the actual lengths ($L_p$) of each other short interval of that segment (Sx).

18. The method of determination as claimed in claim 17, further comprising a step of deducing (27) a respective correction factor ($f_{cor}$) for each short interval ($I_{Sx_i}$) of the toothed target (1) as a function of the actual length ($L_p$) calculated and a theoretical length of the corresponding short interval ($I_{Sx_i}$).

19. The method of determination as claimed in claim 1, further comprising a step of deducing (27) a respective correction factor ($f_{cor}$) for each short interval ($I_{Sx_i}$) of the toothed target (1) as a function of the actual length ($L_p$) calculated and a theoretical length of the corresponding short interval ($I_{Sx_i}$).

20. An electronic module for determination of actual lengths ($L_p$) of short intervals ($I_{Sx_i}$) of a toothed target (1) of a crankshaft of a motor vehicle comprising means of implementing each of the steps of a method of determination as claimed in claim 1.

* * * * *